US010263397B2

(12) United States Patent
Zheng et al.

(10) Patent No.: US 10,263,397 B2
(45) Date of Patent: Apr. 16, 2019

(54) ACTIVE-CONTROL RESONANT IGNITION SYSTEM

(71) Applicant: Ming Zheng, Windsor (CA)

(72) Inventors: Ming Zheng, Windsor (CA); Shui Yu, Windsor (CA); Meiping Wang, Kingsville (CA)

(73) Assignee: Ming Zheng, Windsor (CA)

( * ) Notice: Subject to any disclaimer, the term of this patent is extended or adjusted under 35 U.S.C. 154(b) by 330 days.

(21) Appl. No.: 15/286,128

(22) Filed: Oct. 5, 2016

(65) Prior Publication Data

US 2017/0025825 A1 Jan. 26, 2017

Related U.S. Application Data

(62) Division of application No. 14/329,628, filed on Jul. 11, 2014, now Pat. No. 9,484,719.

(51) Int. Cl.

| | |
|---|---|
| ***F02P 23/04*** | (2006.01) |
| ***H01T 13/44*** | (2006.01) |
| ***H01T 13/50*** | (2006.01) |
| ***H01T 15/00*** | (2006.01) |
| ***H01T 19/04*** | (2006.01) |

(52) U.S. Cl.

CPC ..... *H01T 19/04* (2013.01); *F02P 23/04* (2013.01); *H01T 13/44* (2013.01); *H01T 13/50* (2013.01); *H01T 15/00* (2013.01)

(58) Field of Classification Search

CPC ..... H01T 19/04; H01T 13/44; H01T 13/50; H01T 15/00; F02P 23/04

USPC ..... 361/263

See application file for complete search history.

(56) References Cited

U.S. PATENT DOCUMENTS 4,219,001 A * 8/1980 Kumagai ..... H01T 13/50 123/143 B

FOREIGN PATENT DOCUMENTS

EP 1515594 A2 * 3/2005 ..... H01T 13/50

OTHER PUBLICATIONS

Machine translation of Nouvel et al. European Patent Document EP 1515594 A2 Mar. 16, 2005.*

* cited by examiner

*Primary Examiner* — Kevin J Comber
(74) *Attorney, Agent, or Firm* — Aventum IP Law LLP

(57) ABSTRACT

A method is disclosed for producing a corona discharge for igniting an air/fuel mixture in an internal combustion engine. An igniter is provided having a discharge tip that protrudes into a combustion zone. During a first stage of a combustion process, a first primary winding of a RF transformer is driven at a first predetermined voltage level and at a first resonant frequency that is based on a first impedance in the combustion zone prior to onset of combustion, for generating a corona discharge at the tip of the igniter. During a second stage subsequent to the first stage, a second primary winding of the RF transformer is driven at a second predetermined voltage level and at a second resonant frequency that is based on a second impedance in the combustion zone at a time that is subsequent to onset of the combustion process.

18 Claims, 14 Drawing Sheets

ACTIVE-CONTROL RESONANT IGNITION SYSTEM

FIELD OF THE INVENTION

The present invention relates to systems and methods for generating and sustaining a corona electric discharge for igniting air-fuel mixtures, such as for instance in an internal combustion engine or a gas turbine.

BACKGROUND OF THE INVENTION

The combustion of an air-fuel mixture, for instance in an internal combustion engine ("ICE") or a gas turbine, typically is initiated using a conventional spark ignition system. An electric arc discharge is generated in the air-fuel mixture, which heats the immediately surrounding air-fuel mixture to an extremely high temperature and causes electrons to escape from their nuclei, thereby creating a relatively small region of highly ionized gas. Combustion reaction(s) are then commenced in this small region of ionized gas. Under appropriate conditions the exothermic combustion reaction (s) heat the air-fuel mixture immediately surrounding the small region of ionized gas to cause further ionization and combustion. This chain-reaction process produces first a flame kernel in the combustion chamber of the ICE or gas turbine, and proceeds with a flame front moving through the combustion chamber until the air-fuel mixture is combusted.

In conventional spark ignition systems the electric arc discharge is created when a high voltage DC electric potential is applied across two electrodes in the combustion chamber. A relatively short gap is formed between the electrodes, such that the high voltage potential causes a strong electric field to develop between the electrodes. This strong electric field causes dielectric breakdown in the gas between the electrodes. The dielectric breakdown commences when seed electrons, which are naturally present in the air-fuel gas, are accelerated to a highly energetic level by the strong electric field. More particularly, a seed electron is accelerated to such a high energy level that when it collides with another electron in the air-fuel gas, it knocks that electron free of its nucleus resulting in two lower energy level free electrons and an ion. The two lower energy level free electrons are then in turn accelerated by the electric field to a high energy level and they, too, collide with and free other electrons in the air-fuel gas. This chain reaction results in an electron avalanche, such that a large proportion of the air-fuel gas between the electrodes is ionized into charge carrying constituent particles (i.e., ions and electrons). With such a large proportion of the air-fuel gas ionized, the gas no longer has dielectric properties but acts rather as a conductor and is called plasma. A high current passes through a thin, brilliantly lit column of the ionized air-fuel gas (i.e., the arc) from one electrode to the other until the charge built up in the ignition system is dissipated. Because the gas has undergone complete dielectric breakdown, when this high current flows there is a low voltage potential between the electrodes. The high current causes intense heating—up to 30,000° F.—of the air-fuel gas immediately surrounding the arc. It is this heat which sustains the ionization of the air-fuel mixture long enough to initiate combustion.

Unfortunately, conventional spark ignition systems have a number of drawbacks and limitations. In an ICE the electrodes of the spark ignition system are typically part of a spark plug, which penetrates into the combustion chamber. The extreme heat that is produced by the electric arc during ignition damages the electrodes over time. Also, because of its reliance upon creating heat to ionize the air-fuel mixture, the maximum energy output of a conventional spark ignition system is limited by the amount of heat the electrodes can sustain. Further, a recent trend is to dilute the air-fuel combustible mixture by increasing the air/fuel ratio, or by increasing the level of exhaust gas recirculation (EGR), thereby enabling operation at higher compression ratios and loads and achieving cleaner and more efficient combustion. Unfortunately, increased dilution levels give rise to problems relating to both ignition and flame propagation in conventional spark ignition systems. As such, a more robust ignition system is required.

Another method for igniting the air-fuel mixture in a combustion chamber of an ICE or a gas turbine is by way of a corona discharge. In this type of system an igniter having center electrode held by an insulator is used, which forms a capacitance together with an outer conductor enclosing the insulator or with the walls of the combustion chamber at ground potential, as counter electrode. The insulator enclosing the center electrode and the combustion chamber, with the contents thereof, act as a dielectric. The capacitance so-formed is a component of an electric oscillating circuit, which is excited using a high-frequency voltage that is created, for example, using a step-up transformer. The transformer interacts with a switching device, which applies a specifiable DC voltage to the primary windings, and produces a sinusoidal alternate current wave in the secondary winding. The secondary winding of the transformer supplies a series oscillating circuit having the capacitance formed by the center electrode and the walls of the combustion chamber. The frequency of the alternating voltage that excites the oscillating circuit is controlled such that it is as close as possible to the resonance frequency of the oscillating circuit. The result is a voltage step-up between the ignition electrode and the walls of the combustion chamber within which the ignition electrode is disposed. Under these conditions, a corona discharge can be created in the combustion chamber.

Unfortunately, after ignition and during combustion the radicals that are produced in the combustion zone cause the capacitance of the combustion zone and the system resonant frequency to change. As such, the corona formation must be controlled during the ignition process in order to achieve optimal ignition results and to prevent the occurrence of arcing. Known approaches for controlling the corona formation and for preventing the occurrence of arcing involve shifting the operating frequency away from the resonant frequency to result in a drop in the high voltage at the ignition electrode to prevent further arcing. Subsequently, the voltage applied to the primary winding can be decreased, then the operating frequency can be returned to the resonant frequency in order to improve efficiency. Such an approach is complex and inefficient.

It would be beneficial to provide a corona ignition system and related methods that overcome at least some of the above-mentioned drawbacks and limitations of known systems.

SUMMARY OF THE INVENTION

In accordance with an aspect of at least one embodiment of the invention, there is provided an ignition device for producing a corona discharge for igniting an air/fuel mixture in an internal combustion engine, comprising: a metallic tube housing; an insulator element fabricated from an insulator material and fixedly secured at a combustion end of the metallic tube housing; a coil wound onto a holder and disposed within the metallic tube housing; a filler material disposed between the coil and the metallic tube housing; and a high voltage electrode arrangement comprising: a first electrode having a first end that is connected to the coil for receiving a voltage therefrom, the first electrode extending at least part of the way through the insulator element; and at least one second electrode having a first end that protrudes from a combustion-side face of the insulator element and having a second end that is embedded within the insulator element, the second end of the at least one second electrode being separated from the first electrode by the insulator material and for capacitively coupling with the first electrode to receive a drive signal therefrom, the at least one second electrode for supporting a corona discharge therefrom.

In accordance with an aspect of at least one embodiment of the invention, there is provided an ignition system for producing a corona discharge for igniting an air/fuel mixture in an internal combustion engine, comprising: a radio frequency (RF) transformer comprising a secondary winding having a high voltage side and a low voltage side and comprising a plurality of primary windings; a plurality of power drive circuits, each power drive circuit coupled to a different primary winding of the plurality of primary windings; an ignition device coupled to the high voltage side of the secondary winding and having a high voltage electrode arrangement for receiving an amplified voltage from the secondary winding and for generating a corona discharge, the ignition device being part of an oscillating circuit having a resonant frequency that changes during different stages of a combustion cycle; a signal generator for providing different command signals to different power drive circuits of the plurality of power drive circuits at respective different stages of the combustion cycle, such that different primary windings are used to produce different high voltage amplitudes at the resonant frequency of the respective stage of the combustion cycle; and a feedback subsystem for detecting an electric and/or electromagnetic field change of the ignition device and for changing the different command signals provided to the different driver circuits of the plurality of driver circuits based on a determined correlation between the sensed current and an operating condition of the internal combustion engine.

In accordance with an aspect of at least one embodiment of the invention, there is provided a method for producing a corona discharge for igniting an air/fuel mixture in an internal combustion engine, comprising: providing an igniter having a discharge tip that protrudes into a combustion zone; during a first stage of a combustion process, driving a first primary winding of a RF transformer at a first predetermined voltage level and at a first resonant frequency that is based on a first impedance in the combustion zone prior to the onset of the combustion process, for generating a corona discharge at the discharge tip of the igniter; and during a second stage of the combustion process that is subsequent to the first stage, driving a second primary winding of the RF transformer at a second predetermined voltage level and at a second resonant frequency that is based on a second impedance in the combustion zone at a time that is subsequent to onset of the combustion process.

In accordance with an aspect of at least one embodiment of the invention, there is provided a method for controlling a corona discharge for igniting an air/fuel mixture in an internal combustion engine, comprising: providing an igniter coupled to the high voltage side of a secondary winding of a RF transformer having at least a primary winding; driving at least one of the at least a primary winding at a first voltage level and at a first resonant frequency during a first stage of a combustion process; during the first stage of the combustion process, sensing current from the low voltage side of the secondary winding; based on the sensed current, determining a second voltage level; and driving at least one of the at least a primary winding at the second voltage level during a second stage of the combustion process.

In accordance with an aspect of at least one embodiment of the invention, there is provided a method for controlling a corona discharge for igniting an air/fuel mixture in an internal combustion engine, comprising: providing an igniter coupled to the high voltage side of a secondary winding of a RF transformer having at least a primary winding, the igniter in communication with a combustion zone of the internal combustion engine; driving at least one of the at least a primary winding at a first voltage level and at a first resonant frequency during a first stage of a combustion process; during the first stage of the combustion process, sensing current from the low voltage side of the secondary winding; determining a correlation between the sensed current and an operating condition of the internal combustion engine; and driving at least one of the at least a primary winding at a second voltage level during a second stage of the combustion process, the second voltage level being different for different determined operating conditions of the internal combustion engine.

In accordance with an aspect of at least one embodiment of the invention, there is provided a method for igniting an air/fuel mixture in an internal combustion engine, comprising: generating a pilot corona discharge having at least one of an energy and a duration that is insufficient to sustain combustion of the air/fuel mixture, wherein at least one of radicals and active products are produced during generating the pilot corona discharge; at a predetermined ignition timing, generating a main corona discharge having sufficient energy and sufficient duration to sustain combustion of the air/fuel mixture.

BRIEF DESCRIPTION OF THE DRAWINGS

The instant invention will now be described by way of example only, and with reference to the attached drawings, wherein similar reference numerals denote similar elements throughout the several views, and in which.

DETAILED DESCRIPTION OF EMBODIMENTS OF THE INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed, but is to be accorded the widest scope consistent with the principles and features disclosed herein.

Figure 1:
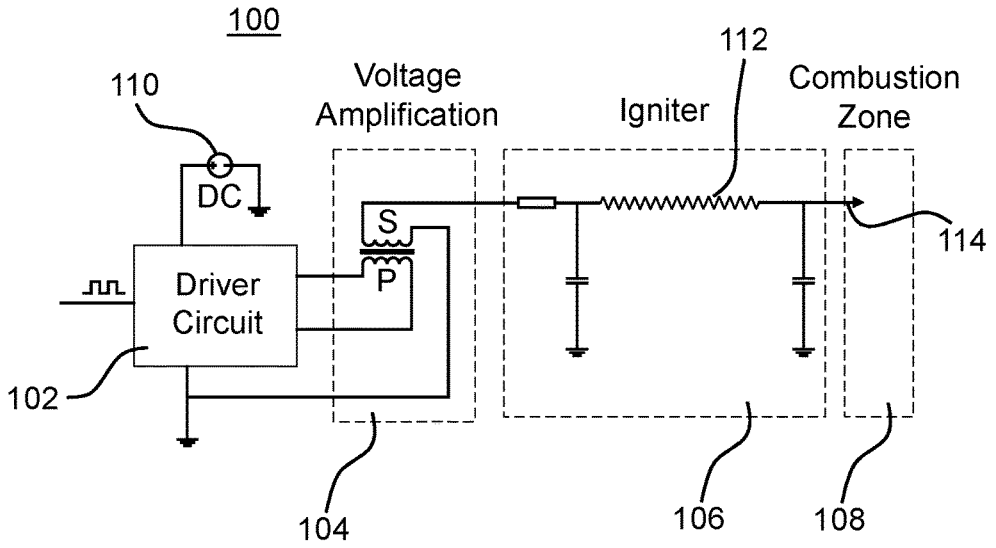
Figure 1 (Prior Art)
FIG. 1 illustrates a corona ignition system according to the prior art.

Referring now to FIG. 1, shown is a prior art corona generating system 100. The corona generating system 100 comprises a driver circuit 102, a RF transformer 104 with a primary winding P and with a secondary winding S, a resonant igniter 106, and a combustion zone 108. Driver circuit 102 is powered by a direct current (DC) source 110, and drives the primary winding P of the RF transformer 104 at an operating frequency of the system 100. For a practical application, the DC voltage can be produced using a switching power converting circuit from a 12V battery.

Igniter 106 includes a resonant coil 112, which is enclosed by a metal shell (not shown in FIG. 1) for eliminating magnetic interference and for mounting the igniter relative to the combustion zone 108. A parasitic capacitor is formed between the coil 112 and the metal shell. Igniter 106 further includes a centered high voltage electrode 114 protruding into the combustion zone 108. The combustion zone 108, e.g., a combustion chamber of an internal combustion engine, normally is a volume that is bounded by metallic cylinder walls and a surface of a reciprocating element, such as a piston. The protruding electrode 114 together with the combustion zone 108, including the contents of the combustion zone 108, forms another capacitor. The inductor of the coil 112, the parasitic "capacitors" and the combustion zone capacitor forms an oscillating circuit. As will be apparent, the natural resonant frequency of an oscillating circuit is fixed if the resistance, inductance and capacitance are fixed. In particular, the resonant frequency is obtained using equation (1):

$$f_{resonant} = \frac{1}{2\pi\sqrt{LC}} \quad (1)$$

where L is inductance and C is capacitance. Application of an alternating current (AC) signal to the oscillating circuit, at the resonant frequency of the oscillating circuit, generates a magnified voltage output signal at the igniter electrode 114.

After ignition or during combustion, radicals are produced in the combustion zone 108, and hence the capacitance of the combustion zone 108 as well as the system resonating frequency changes. It is therefore beneficial to provide control of such a system based on a feedback signal, in order to compensate for these changes and to optimize ignition results. According to at least some embodiments of the invention, feedback of the high frequency resonant plasma ignition system is based on electric and/or electromagnetic field detection. For example, inductive coupling detects magnetic fields and capacitive coupling detects electric fields. Amplitude contours of both the inductive coupled and the capacitive coupled feedback signals follow similar trends, with some phase differences in an individual oscillation cycle. System feedback control can be based on either the inductive detected signal or the capacitive coupled signal, or a combination of both.

Figure 2:
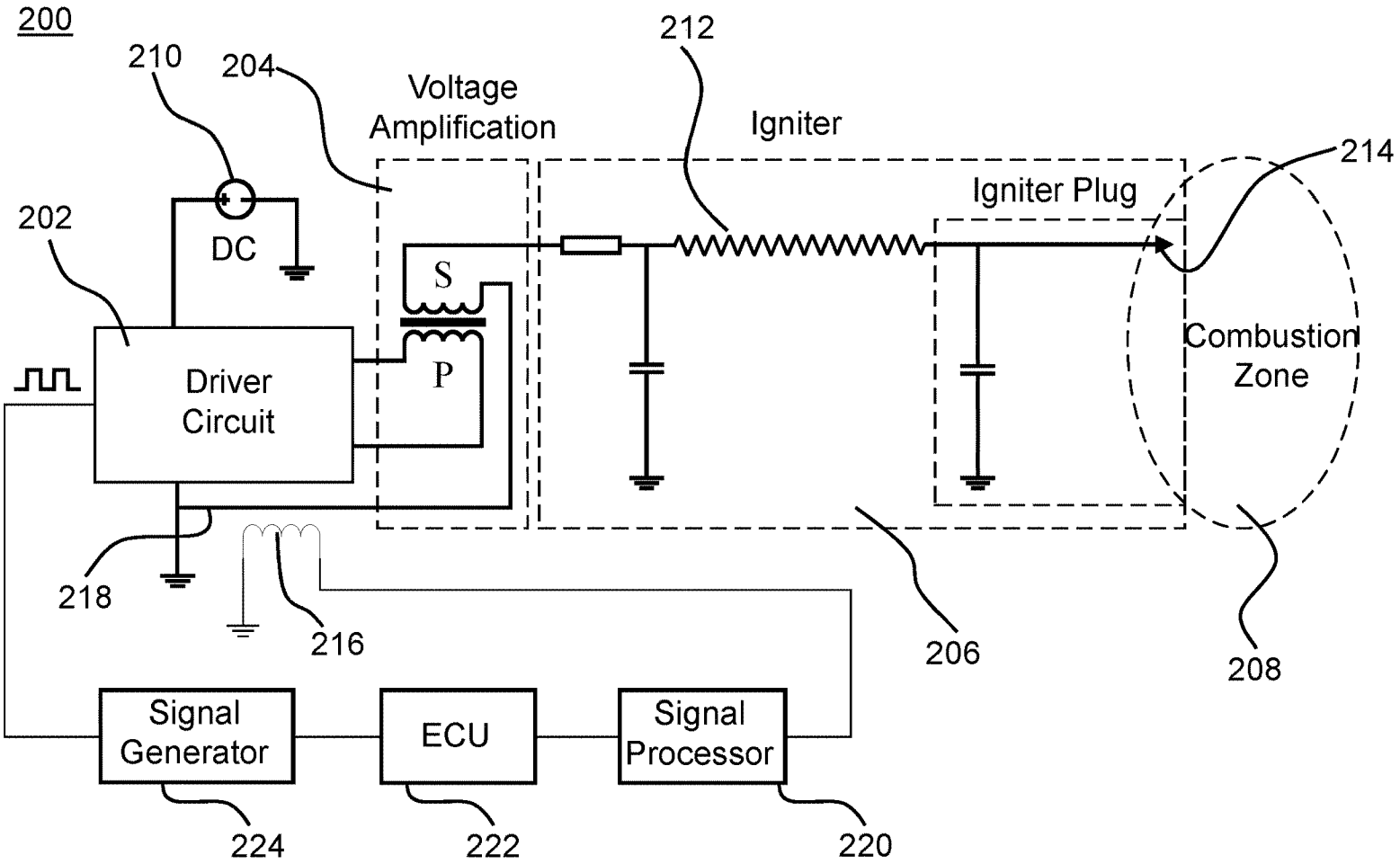
FIG. 2 is a resonant igniter circuit diagram relying on inductive feedback according to an embodiment.

Shown in FIG. 2 is a system 200 with inductively coupled feedback, according to an embodiment of the invention. The corona generating system 200 comprises a driver circuit 202, a RF transformer 204 with a primary winding P and with a secondary winding S, a resonant igniter 206, and a combustion zone 208. Driver circuit 202 is powered by a direct current (DC) source 210, and drives the primary winding P of the RF transformer 204 at an operating frequency of the system 200. For a practical application, the DC voltage can be produced using a switching power converting circuit from a 12V battery.

Igniter 206 includes a resonant coil 212, which is enclosed by a metal shell (not shown in FIG. 2) for eliminating magnetic interference and for mounting the igniter relative to the combustion zone 208. A parasitic capacitor is formed between the coil 212 and the metal shell. Igniter 206 further includes a centered high voltage electrode 214 protruding into the combustion zone 208. The combustion zone 208, e.g., a combustion chamber of an internal combustion engine, normally is a volume that is bounded by metallic cylinder walls and a surface of a reciprocating element, such as a piston. The protruding electrode 214 together with the combustion zone 208, including the contents of the combustion zone 208, forms another capacitor. The inductor of the coil 212, the parasitic "capacitors" and the combustion zone capacitor forms an oscillating circuit.

Referring still to FIG. 2, a coil 216 is wound around a piece of the voltage amplifier's secondary winding wire 218, serving as an electromagnet field detector. According to the principle of inductive coil coupling (i.e. the transformer basic), the detected signal gives a response to the current change in the resonant loop, upon both the phase and amplitude. The corona ignition system 200 further includes a feedback and control subsystem. Signal processor 220 is designed to acquire the feedback signal from the inductive coupled electromagnet field detector 218. The signal processor 220 also conditions the signals and produces amplitude contour curves. Based on the amplitude contours, and using a database of predetermined operating parameters such as ignition timing, commanded frequency and duration, etc., the electronic control unit (ECU) 222 determines actual operating conditions of the system 200. ECU 222 provides control signals to signal generator 224, which generates drive signals based on the actual operating conditions of the system 200.

Figure 3:
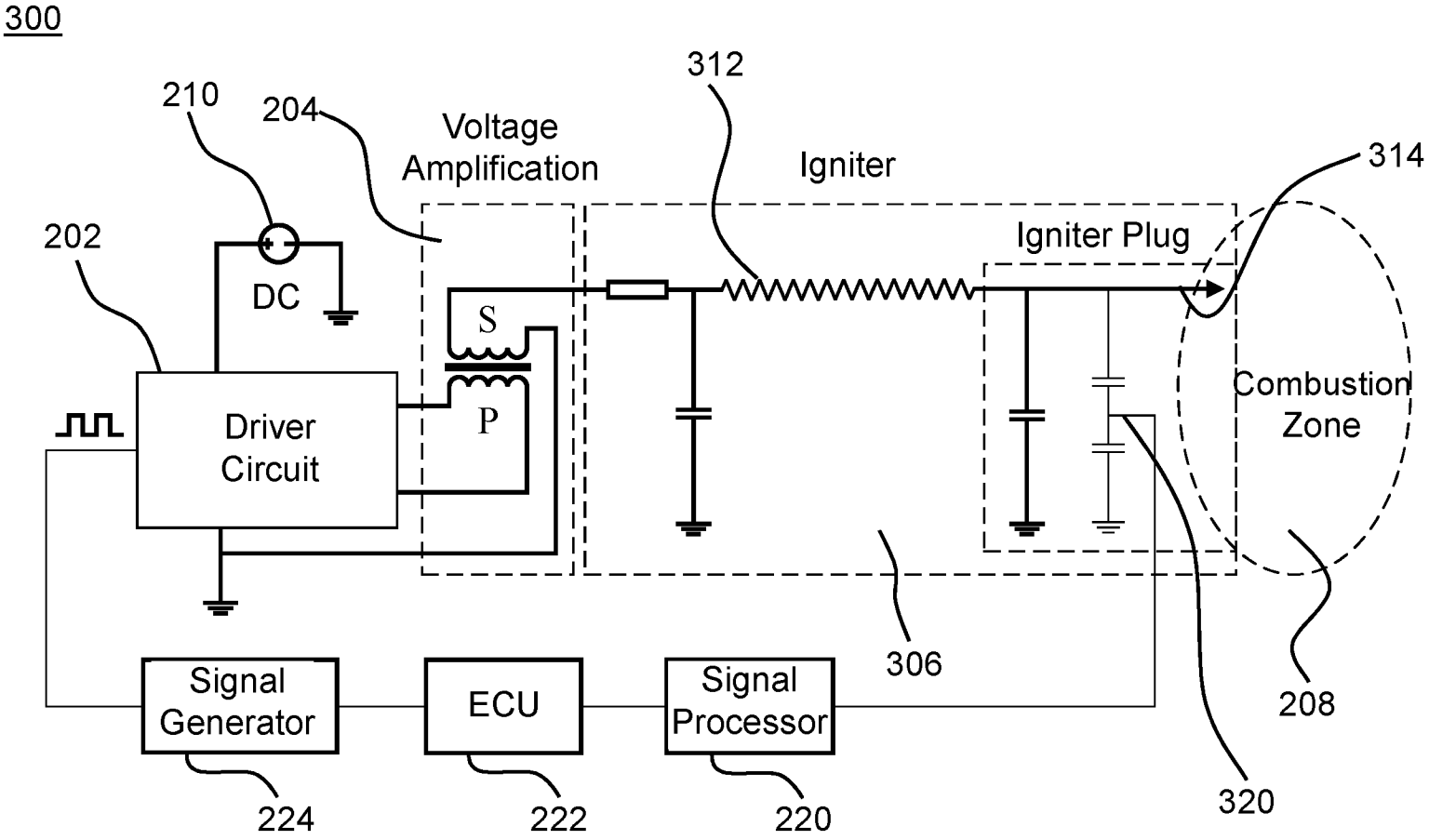
FIG. 3 is a resonant igniter circuit diagram relying on capacitive feedback according to an embodiment.

Shown in FIG. 3 is a system 300 with capacitive coupled feedback, according to an embodiment of the invention. Similar reference numerals denote similar elements described with reference to FIG. 2. Resonant igniter 306 includes a resonant coil 312, which is enclosed in a metal shell not shown in FIG. 3) for eliminating magnetic interference and for mounting the igniter relative to the combustion zone 208. A conductive element 320 is embedded into the resonant igniter plug 306 (see also FIG. 17 conductive element 1704) to detect the electric field, forming a virtually capacitive voltage divider. The signal gives a response to the voltage change at the electrode discharge tip 314, upon both phase and amplitude. The corona ignition system 300 further includes a feedback and control subsystem. Signal processor 220 is designed to acquire the feedback signal from the capacitive coupled electric detector 302. The signal processor 220 also conditions the signals and produces amplitude contour curves. Based on the amplitude contours, and using a database of predetermined operating parameters such as ignition timing, commanded frequency and duration, etc., the electronic control unit (ECU) 222 determines actual operating conditions of the system 300. ECU 222 provides control signals to signal generator 224, which generates drive signals based on the actual operating conditions of the system 300.

The capacitive coupled feedback signal can indicate the discharge voltage when well calibrated. The amplitude of the capacitive coupled feedback signal provides a direct feedback of the discharge process. In an internal combustion engine application, the discharge voltage threshold to form an arc under a range of rpm and torque conditions can be pre-calibrated to set the control set-points for the ignition system.

The inductive coupled feedback signal indicates an overall current provided to the resonator, but not the corona discharge current. As such, the amplitude of the inductive coupled feedback signal is useful for feedback control, but provides only indirect feedback of the discharge process.

Figure 4:
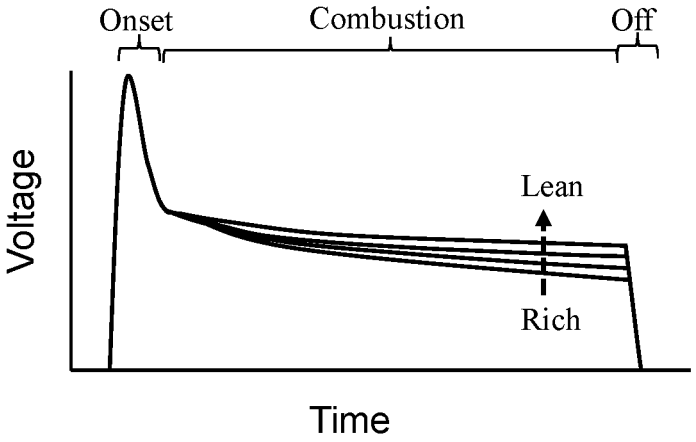
FIG. 4 is a plot showing voltage vs. time during combustion, for different air/fuel ratios.

FIG. 4 shows an example of feedback signal amplitude contours obtained using inductive coupling or capacitive coupling, as described with reference to FIG. 2 or FIG. 3, when different air-fuel mixtures are used. The amplitude contours shown in FIG. 4 indicate a trend of the output high voltage. In FIG. 4, only the positive half of the amplitude contour curves are shown and it is to be understood that the not shown negative half of the signal is typically symmetrical with respect to the positive half. The actual signals from the detector are series of sine waves at the resonating frequency. As such, the amplitude contour curves that are shown in FIG. 4 are the envelopes of the peak or valley of the oscillating waves.

The signal amplitude contour can be divided into three stages during an ignition process, i) onset, ii) combustion and iii) off. Once the resonating starts, the voltage at the discharge electrode increases to a peak value on a timescale of tens of microseconds, depending on the air-fuel mixture condition, e.g. the temperature, pressure and air-fuel ratio. It is during this time that the onset of the corona discharge occurs. Once an ionized channel is formed in the air-fuel mixture in the combustion zone 208, the capacitance of the combustion zone 208 changes (normally decreases), thereby changing the natural resonant frequency of the whole system 200 or 300. While the commanded oscillating frequency is maintained the same, the whole system will oscillate at a frequency different than the resonant frequency. Therefore, the voltage decreases after the onset of discharge. As is shown in FIG. 4, the feedback signal amplitude contour curve is a good indicator of the air-fuel mixture strength in the combustion zone 208, since richer air-fuel mixtures result in the production of more radicals compared to leaner air-fuel mixtures, thereby causing a stronger initial discharge and a more significant voltage drop during the combustion stage.

Figure 5:
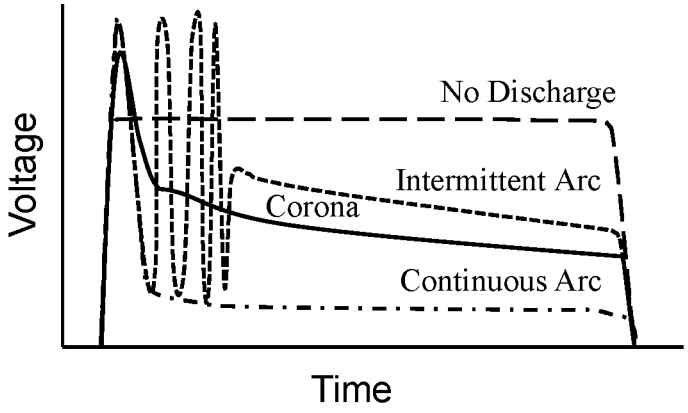
FIG. 5 is a plot showing voltage vs. time under conditions of no discharge, intermittent arc, continuous arc and corona.

One of the advantages of employing corona discharge as the ignition source is that it can reduce the current that is drawn, and the discharge plasma temperature is lower. Ideally, the lower plasma temperature reduces wear on the electrode and increases the lifetime of the igniter. However, in practice, arcing can occur during operation of the corona ignition system 200 or 300 due to the highly varied conditions in the combustion zone 208. FIG. 5 shows the amplitude contour curve patterns according to different discharge modes. As a baseline for discussion, the solid line shows a corona discharge, having been described previously. If there's no discharge at all, the voltage is nearly constant during the oscillation period, with the amplitude lower than the peak corona onset voltage. Arcing can happen either intermittently or continuously. The peak of the arcing onset voltage is higher than that of a corona discharge. The intermittent arcing can take place throughout the discharge period, or it can occur during only part of the discharge period combining with the corona discharge at the beginning, middle, or end of the discharge. When continuous arcing occurs, the voltage is greatly reduced after the breakdown compared to that of a corona discharge.

As will be apparent based on the foregoing discussion, the prevention of arcing (complete dielectric breakdown) during operation of a corona discharge ignition system is beneficial in ensuring an effective ignition process. Arc prevention strategies may include a control system for arc detection and elimination, as well as the use of various igniter tip designs that are more resistant to arc formation.

Figure 6:
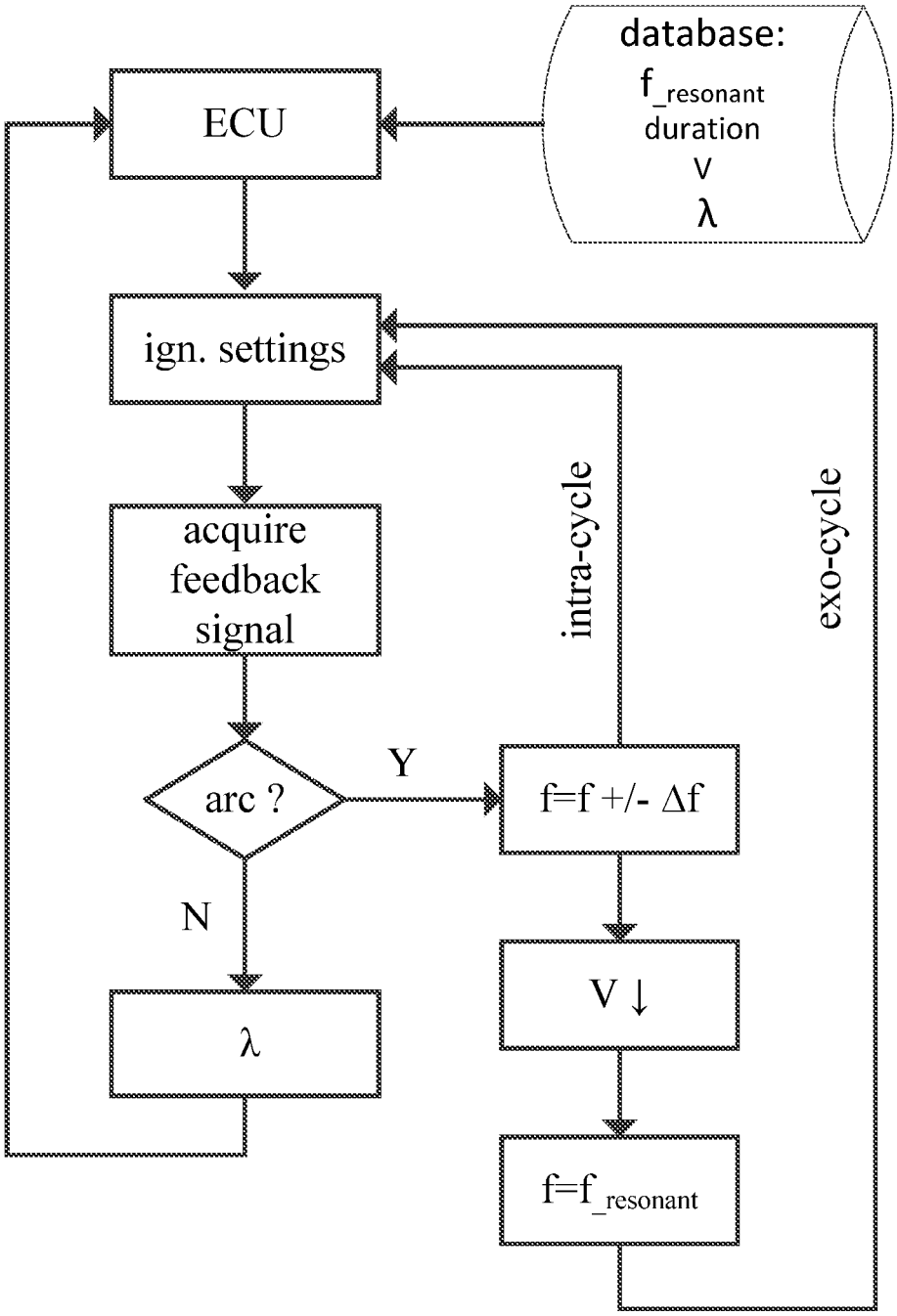
FIG. 6 is a simplified flow diagram for a control process, according to an embodiment of the invention.

Referring now to FIG. 6, shown is a simplified flow diagram for a method of controlling an ignition system and eliminating arcing based on an acquired amplitude contour curve. The ECU sets the ignition parameters according to a database including predetermined resonating frequency, discharge duration, supplied primary voltage etc. The database is determined through engine benchmarking with the principles targeting to achieve largest corona discharge size and without triggering arcing. But in real-time engine running, the highly varied in-cylinder conditions could cause inevitable arcing, thus an arc detection and elimination mechanism is required. During discharge, an amplitude contour is acquired and the discharge pattern is detected. If arcing is detected, the process terminates the command signal for a short period, e.g. 10 microseconds, to stop the discharge. Then the process resets the command and changes the command signal frequency within the same combustion cycle. Then the supplied voltage to the primary winding is decreased. In order to keep the system oscillating at resonant frequency for the sake of minimizing energy dissipation on the resistor of the resonator, the command signal frequency is reset to resonant frequency after the supplied voltage is adjusted. Due to the relatively slow process of the adjustment of supplied voltage, it can take several combustion cycles or longer for this adjustment. If there is only corona discharge and arcing is avoided, the process estimates the air-fuel ratio (k), and then reports the air-fuel ratio to the ECU fuel injection control.

Figure 7:
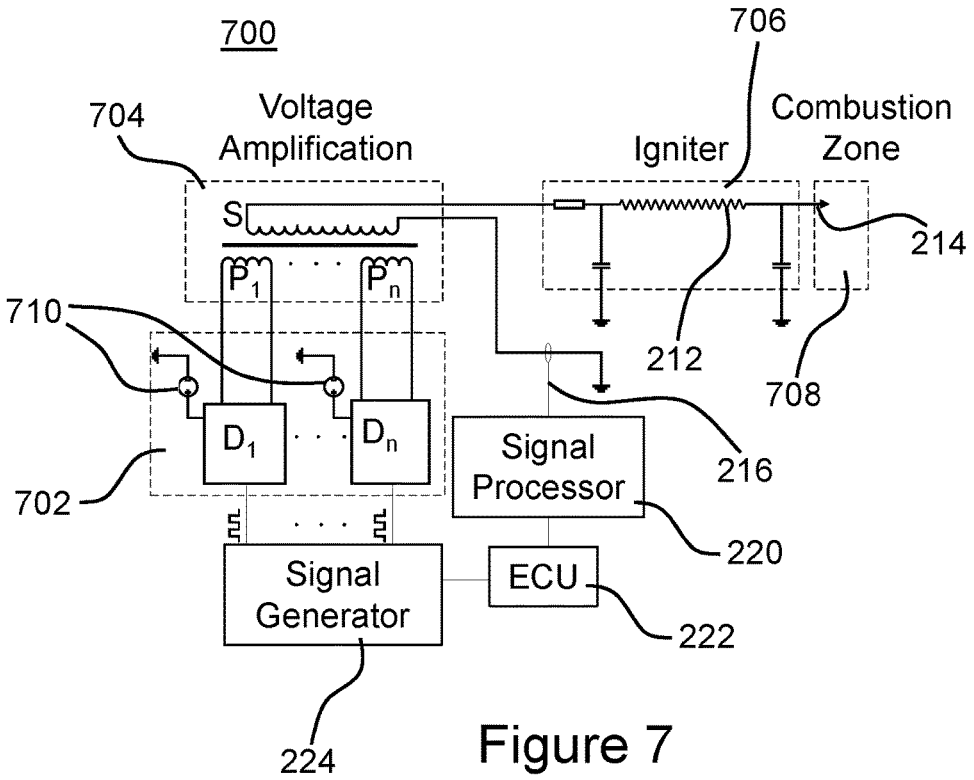
FIG. 7 illustrates a corona ignition system, including a RF transformer with plural primary windings, according to an embodiment of the invention.

For a desired corona ignition process, a higher voltage should be generated at the beginning to trigger the onset of corona, while a continuously reduced voltage is required during the discharge and mixture combustion processes since the gas in the combustion zone becomes more conductive. Referring now to FIG. 7, shown is a corona ignition system comprising a RF transformer having a plurality of primary windings, which is capable of producing such a desired condition. The corona ignition system 700 comprises a driver circuit portion 702, a RF transformer 704, a resonant igniter 706, and a combustion zone 708. In particular, driver circuit portion 702 comprises a plurality of driver circuits $D_1 \ldots D_n$, each driver circuit powered by a different direct current (DC) source 710. Each driver circuit $D_1 \ldots D_n$ drives a different primary winding $P_1 \ldots P_n$ of the RF transformer 704. In practice, the DC voltage can be produced using a switching circuit from a 12V battery. Optionally, the system 700 is configured to use a single DC source and step-up transformers to power all of the driver circuits $D_1 \ldots D_n$. Optionally, the RF transformer 704 is an air core RF transformer. Further optionally, the RF transformer 704 is a ferrite core RF transformer.

Figure 8:
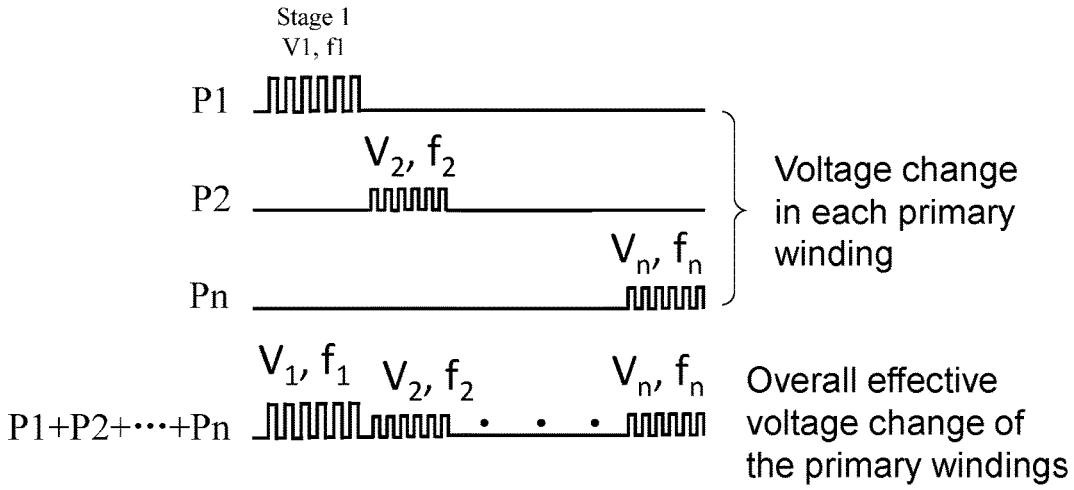
FIG. 8 shows voltage signals produced using a RF transformer with plural primary windings, according to an embodiment of the invention.

Referring now to FIG. 8, shown is the voltage change that is produced using RF transformer 704 with plural primary windings $P_1 \ldots P_n$. Each primary winding is operated at a respective frequency $f_1 \ldots f_n$ and voltage level. The overall effective voltage change of the plurality of primary windings in the RF transformer 704 is shown at the bottom of FIG. 8. By switching between windings, rapid changes in voltage are supported without opposition from the coils.

Figure 9:
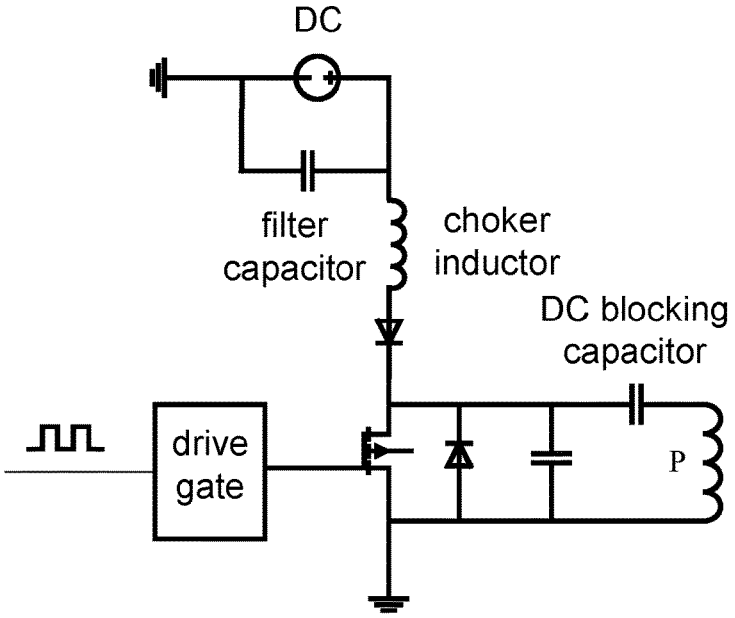
FIG. 9 is a circuit diagram for a first driver circuit.
Figure 10:
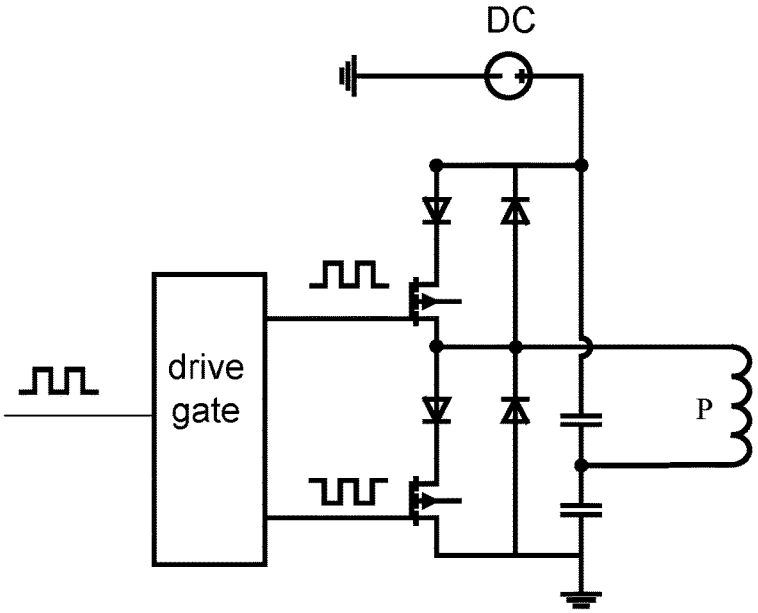
FIG. 10 is a circuit diagram for a second driver circuit.
Figure 11:
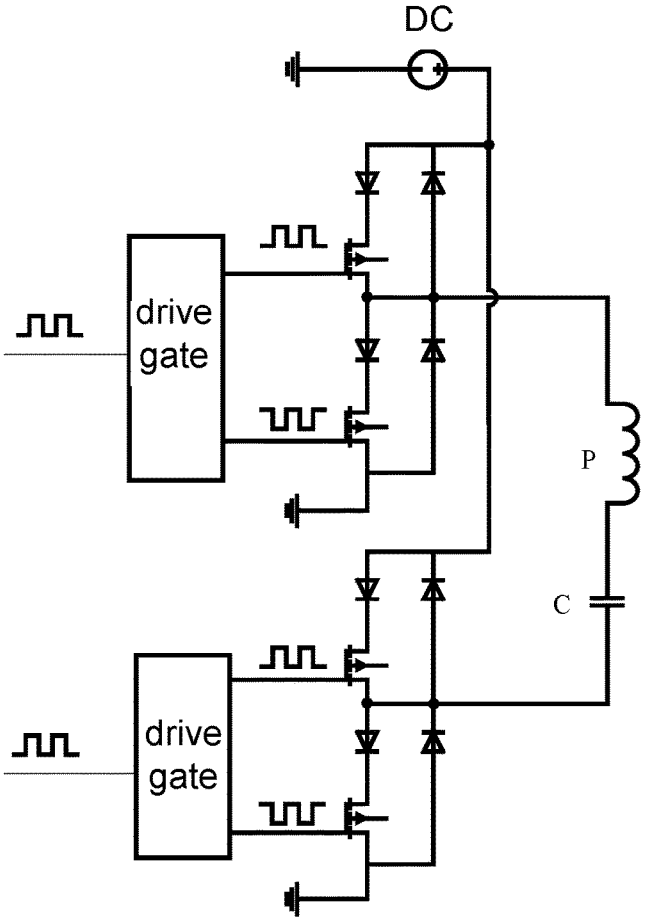
FIG. 11 is a circuit diagram for a third driver circuit.

As discussed with reference to FIG. 7, each primary winding $P_1 \ldots P_n$ is driven by a corresponding power driver $D_1 \ldots D_n$. FIGS. 9-11 illustrate different power drivers that are suitable for use with the system of FIG. 7.

FIG. 9 is a circuit diagram showing a first driver circuit. The primary winding (P) of the RF transformer is driven by a power drive with one MOSFET. The inductor of the primary winding and a paralleled capacitor form an oscillating loop. The on/off of the MOSFET generates the oscillation in the loop with a frequency controlled by the MOSFET. A DC blocking capacitor is employed to prevent a DC portion of current propagating through the primary winding during a static condition. Choker inductor and filter capacitors are used to block the high frequency noise from propagating back to the DC power supply. A series connected Schotty diode is used to bias the MOSFET. A fast recovery diode is paralleled with the MOSFET to protect the MOSFET from transient overvoltage during the switching process. A gate drive circuit is employed to amplify the command signal to a power level sufficient for driving the MOSFET.

FIG. 10 is a circuit diagram showing a second driver circuit. The primary winding (P) of the RF transformer is driven by a power drive with two MOSFETs. One end of the winding is connected to a point between the two MOSFETs; the other end is connected between two capacitors, which divide the DC voltage and give a reference voltage to the primary winding. Schotty diodes and fast recovery diodes are connected for each MOSFET. The MOSFETs operate oppositely to generate oscillation in the primary winding. The advantage of a half bridge circuit over a single MOSFET circuit is that the half bridge circuit can stand with a doubled DC voltage, extending the high voltage output limit. The power drive is powered by a DC voltage source. For a practical application, the DC voltage is produced by a switching circuit from the 12V battery. The gate drive is optionally an integrated high side and a low side IC driver to drive both the MOSFETs. When two same type of IC drivers are used, one is typically floated functioning as the high side switch.

FIG. 11 is a circuit diagram showing a third driver circuit. The primary winding (P) of the RF transformer is driven by a power drive with four MOSFETs with an H-bridge structure. The full bridge circuit comprises two identical half-bridge circuits. The oscillation loop is formed by the series connection of the primary inductor and a matching capacitor. The full bridge circuit further extends the high voltage output limit by doubling the voltage change in the primary winding.

Resonant ignition systems operate at different frequencies from kilohertz to several megahertz, depending on the size of the igniter package. At megahertz frequency, switching power dissipation on the MOSFET is significant. The inexpensive class E MOSFET will fail to last long when operated at such high frequency in this application. By synchronously operating multiple primary windings, power dissipation on each MOSFET is reduced. The term "synchronously operating" is used herein to mean that one primary winding oscillates while the other one also oscillates. However, the phase of the oscillation cycle may differ. This mode typically applies to a system with identical primary windings.

Figure 12A:
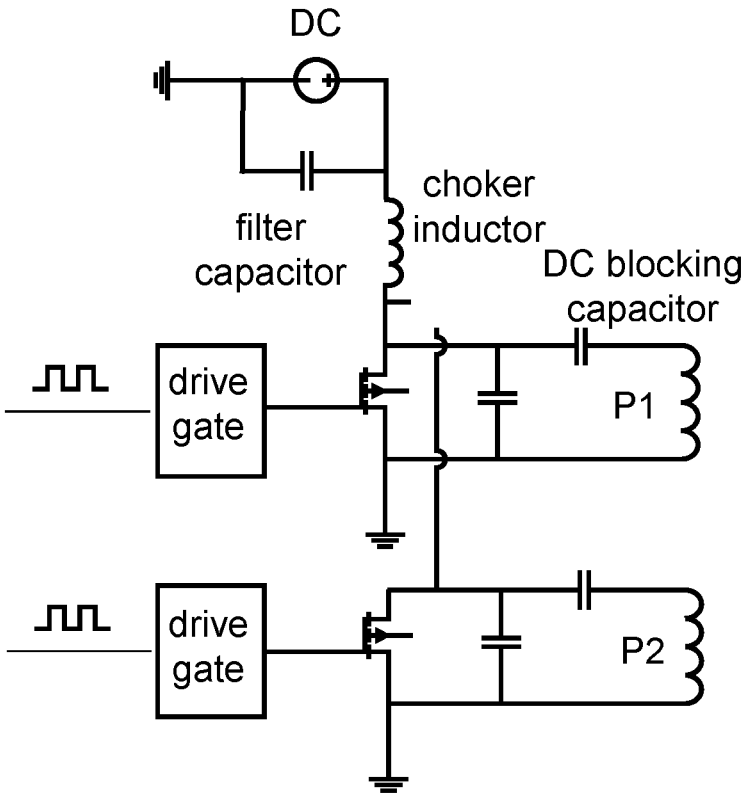
FIG. 12A shows an igniter circuit having a single drive MOSFET.
Figure 12B:
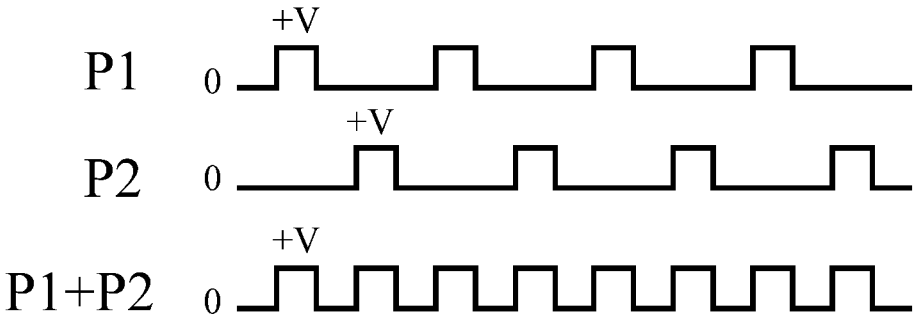
FIG. 12B shows a timing diagram for the operation of the circuit of FIG. 12A.

FIGS. 12A-B show an example of the synchronous operating mode of a dual-primary winding system with the single MOSFET drive configuration of FIG. 9. A circuit (FIG. 12A) is presented with an operating sequence shown in the timing diagram of FIG. 12B. Both primary windings P1 and P2 operate at half of the resonant frequency with 25% duty cycle, with the phase of P2 delayed a half cycle. The combination of signals from two windings produces a same magnet flux change as that at the resonant frequency with 50% duty cycle. For the configuration with n primary windings, given a desired resonant frequency (f_res), and duty cycle (D), the frequency and the duty cycle of an individual winding is 1/n*f_res and 1/n*D, respectively. The phase of each winding is sequentially delayed 1/n cycle.

Figure 13A:
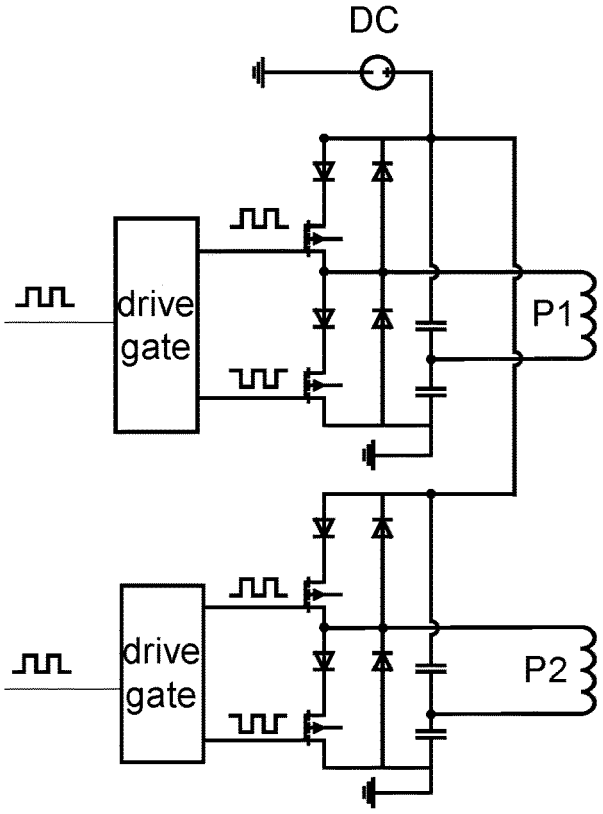
FIG. 13A shows an igniter circuit having multiple MOSFETs.
Figure 13B:
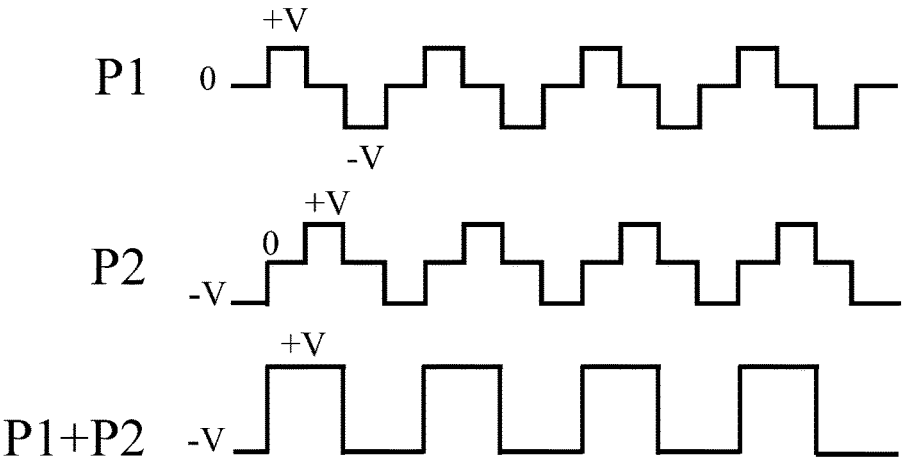
FIG. 13B shows a timing diagram for the operation of the circuit of FIG. 13A.

FIGS. 13A-B illustrates an example of a synchronous operating mode of a dual-primary winding system with the bridge drive configuration of FIG. 10. FIG. 13A is a circuit diagram and FIG. 13B is a timing diagram, showing an operating sequence. Each MOSFET operates at the resonant frequency with 25% duty cycle. The overall four MOSFETs produce a same magnet flux change as that at resonant frequency with 50% duty cycle. For the configuration with n primary windings, given a desired resonant frequency (f_res), and duty cycle (D), the frequency and the duty cycle of an individual winding is f_res and 1/n*D, respectively.

Because the power dissipation is distributed to multiple MOSFETs, each MOSFET only bears a portion of the overall load; hence the durability of the MOSFETs is improved.

Due to the ability to continuously discharge plasma, the resonant ignition system can run with a pilot+main ignition scheme, i.e. a number of pilot corona discharges are generated with intensity insufficient to sustain a successful ignition process, prior to a main discharge that triggers the ignition. Although the pilot corona discharges cannot ignite the mixture, they treat the mixture and produce radicals or some active products. Once the main discharge ignites the mixture, the residual radicals produced by the pilot discharge will enhance the flame kernel development.

Figure 14:
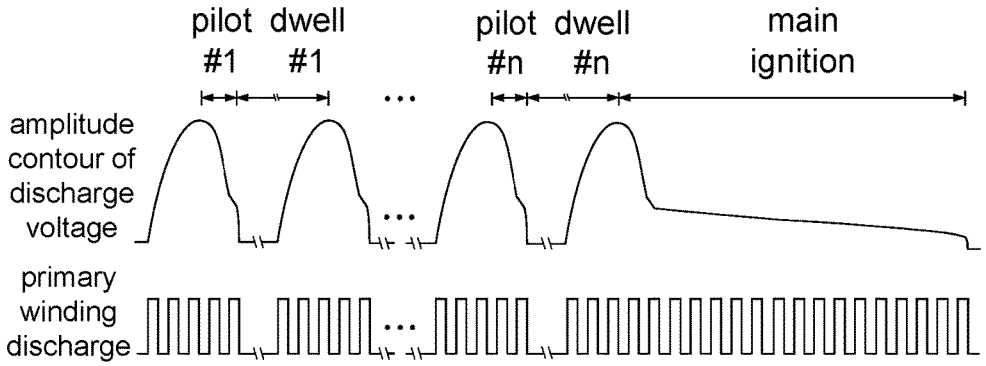
FIG. 14 shows a timing diagram.

FIG. 14 shows the pilot+main ignition scheme for a single-primary winding system. For the pilot discharges, discharge durations are kept short to maintain the mixture unignited. A main ignition discharge lasts long enough to ignite the mixture.

Figure 15:
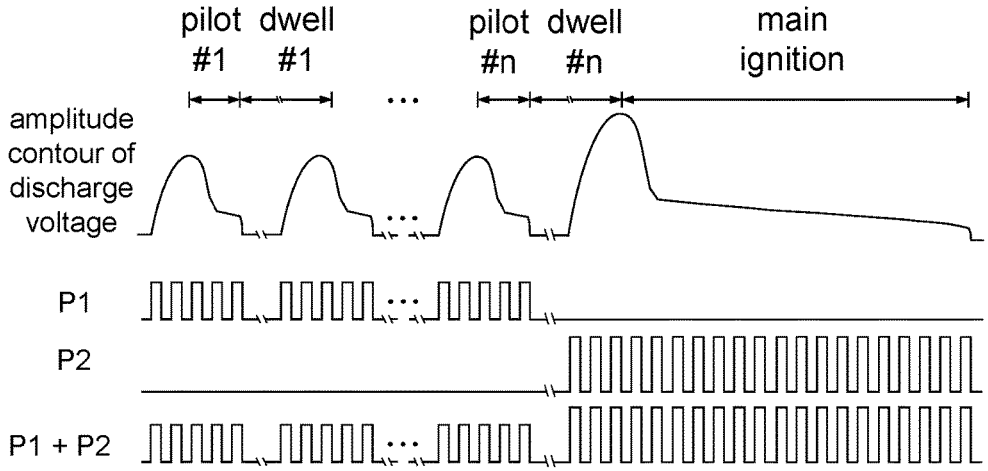
FIG. 15 shows another timing diagram.

A multiple primary winding ignition system provides more flexibility in distribution of the pilot and main discharges. FIG. 15 shows an example of the pilot+main ignition scheme for a dual-primary winding system. The pilot discharges are produced with one or more of the primary windings, at relatively low voltage. The duration is optionally longer than that for a single primary winding system as the primary voltage is lower. The main discharge is optionally generated by other primary windings with a higher voltage and/or a longer duration.

The pilot+main ignition scheme is particularly beneficial to the ignition of a lean and/or diluted mixture. Since a lean and/or diluted mixture normally needs a more intense and longer duration discharge for a successful ignition. It gives more flexibility when determining pilot duration, voltage, and number. From the point of view of internal combustion engine control, the pilot+main ignition scheme also has advantages. For a lean mixture ignited by a single long corona discharge, the slow flame propagation at an early ignition stage causes the ignition timing control to be inaccurate. With the pilot+main ignition scheme, a faster flame kernel growth is produced by the main ignition as assisted by residual radicals. Thus, the ignition timing control accuracy is significantly improved.

Figure 16:
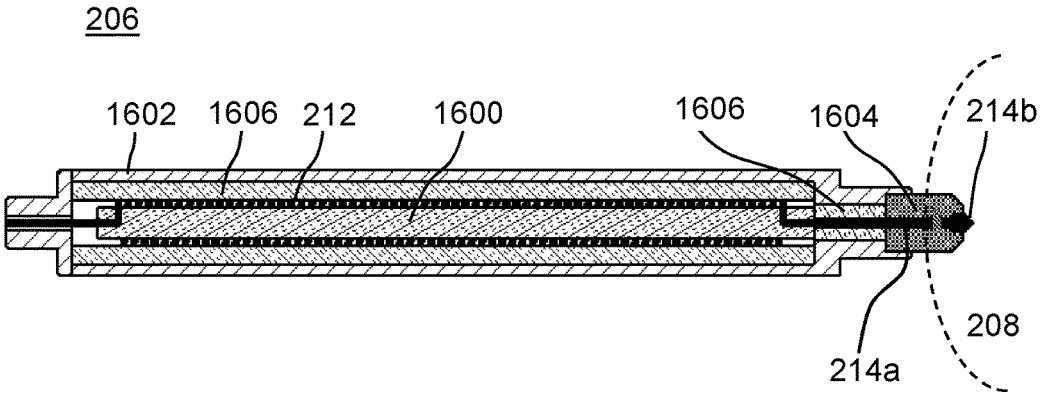
FIG. 16 is a cross-sectional view of an igniter, according to an embodiment of the invention.

Now referring to FIG. 16, shown is an enlarged cross-sectional view of the igniter 206 of FIG. 2. Igniter 206 includes a resonant coil 212, which is wound onto a holder 1600. The coil 212 is enclosed by a metal shell 1602 for eliminating magnetic interference and for mounting the igniter 206 relative to the combustion zone 208. A parasitic capacitor is formed between the coil 212 and the metal shell 1602. Igniter 206 includes a high voltage electrode assembly 214, which protrudes into the combustion zone 208. As is shown in FIG. 16, the high voltage electrode assembly 214 includes a first electrode 214*a* connected to the coil 212. The first electrode 214*a* terminates within an insulator element 1604 that is fixedly mounted at one end of the igniter 206. A second electrode 214*b*, which is separated from the first electrode 214*a* by the material of the insulator element 1604, protrudes from the end of the igniter 206 and extends into the combustion zone 208. The second electrode 214*b* is capacitively coupled to the first electrode 214*a*. The second electrode 214*b* optionally has high curvature tip that enhance the voltage gradient around the electrode.

Referring still to FIG. 16, the insulator element 1604 is provided only at the end of the igniter 206 that extends into the combustion zone 208. As noted above, one end of the first electrode 214*a* is embedded in the insulator element 1604. The second electrode 214*b*, which is capacitively coupled to the first electrode 214*a*, protrudes from the combustion-side face of the insulator element 1604. For instance, the insulator element 1604 is fabricated from a ceramic insulator material and has a relatively high dielectric constant compared to the filler material 1606. By limiting the use of materials with high dielectric constants in the igniter 206, i.e. only at the end that protrudes into the combustion zone 208, the parasitic capacitance is also limited. Advantageously, the relatively small insulator element 1604 is able to withstand the in-cylinder high pressure and high temperature conditions. The low dielectric constant filler materials 1606 (e.g. PFTE) optionally has low mechanical strength. Further, high permeable resin is applied to fill up all the gaps in the igniter in order to eliminate air spaces, which otherwise could result in undesired corona discharges once high voltage AC is applied.

Figure 17:
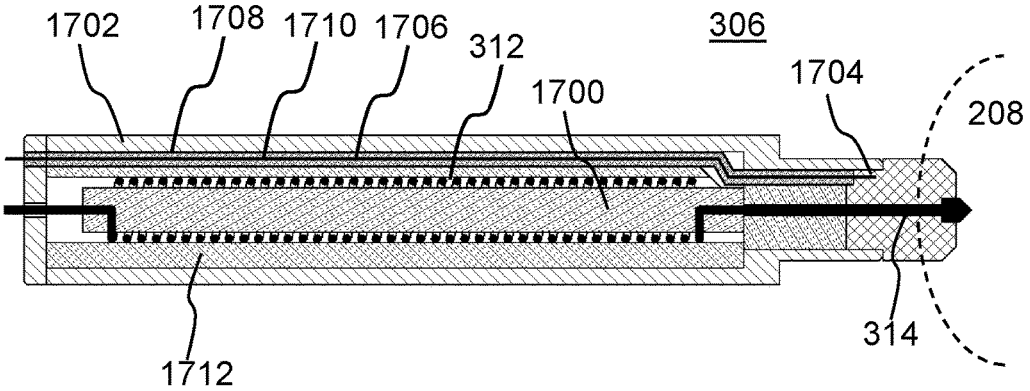
FIG. 17 is a cross sectional diagram of an igniter relying on capacitive feedback.

FIG. 17 shows an example of an igniter with a capacitive coupled electric field detector, such as for instance the igniter 306 of FIG. 3. Igniter 306 includes a resonant coil 312, which is wound onto a holder 1700. The coil 312 is enclosed by a metal shell 1702 for eliminating magnetic interference, and for mounting the igniter 306 relative to the combustion zone 208. A parasitic capacitor is formed between the coil 312 and the metal shell 1702. Igniter 306 also includes a high voltage center electrode 314, which protrudes into the combustion zone 208. A conductive element 1704 is embedded close to the high voltage center electrode 314. The conductive element 1704 forms a capacitor with the center electrode 314 and a capacitor with the grounded metal shell 1702. The electric field between the central electrode 314 and the metal shell 1702 is divided by the conductive element 1704. Thus the voltage at the conductive element 1704 is proportional to the oscillating high voltage at the center electrode 314, with an attenuation determined by the capacitance ratio of the two capacitors. A wire 1706 within a shield 1708 is embedded in the igniter 306 to transmit the signal formed on the conductive element 1704 to the controller. The shield 1708 attenuates electric field interference along the path of the wire 1706, thus the signal reflects only responses to electric field change at the location of the conductive element. The material 1710 between the wire and the shield is optionally any insulating material no matter the dielectric properties. The shield 1708 can be connected to ground or floated. To obtain a high attenuation, the conductive element 1704 is located closer to the metal shell 1702 than to the central electrode 314. The conductive element 1704 shown in FIG. 17 has a rod shape. Alternatively, the conductive element 1704 has another shape, such as for instance one of a plate, a sphere, a cylinder surrounding the central electrode, etc. The shield 1708 is optionally a metal tube. Alternatively the shield 1708 is a metal braid.

The physical structures of the resonant igniter 206 or 306 are functional as parts of the ignition system 200 or 300, respectively, e.g. forming the inductor and capacitors for the oscillation circuit. The inductance of the coil 212 or 312 is determined by the coil diameter, length and number of turns. The dimension of the coil 212 or 312 and of the metal shell 1602 or 1702, respectively, determine the parasitic capacitance, but the dielectric property of the filling materials 1606 between the coil 212 and the metal shell 1602, or the filling material 1712 between the coil 312 and the metal shell 1702, also plays an important role in determining the capacitance. In particular, a filler material 1606 or 1712 with a larger dielectric constant results in a higher capacitance compared to a filler material with a smaller dielectric constant.

The resonant frequency of the oscillating circuit is determined by both the inductance (L) and the capacitance (C). Although different combinations of the inductance and the capacitance can be used to provide a same resonant frequency, it is a basic principal of circuit design to minimize the parasitic capacitors because a small capacitor will increase the Q-fact of a series LC circuit, thereby reducing energy loss. In other words, higher capacitance causes more energy to be dissipated in the parasitic capacitor since AC passes through capacitors. Accordingly, with specific reference to FIG. 16, a filler material 1606 having a low dielectric constant is provided between the coil 212 and the metal shell 1602 in the igniter 206. More particularly, the filler material 1606 has a dielectric constant that is less than the dielectric constant of aluminum oxide. Similar considerations also apply to the construction of igniter 306 of FIG. 17. By way of a specific and non-limiting example, the dielectric constant of the filler material 1606 or 1712 is less than 3. In addition, the filler material 1606 or 1712 should be a non-porous or low porous material, which has good insulating properties.

Figure 18A:
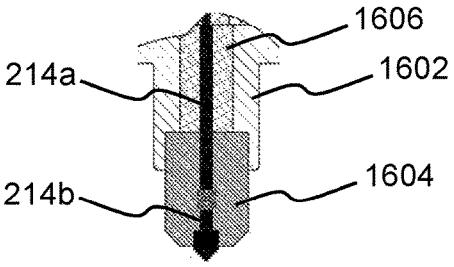
FIG. 18A is a cross-sectional view of the tip portion of a first igniter, according to an embodiment of the invention.
Figure 19A:
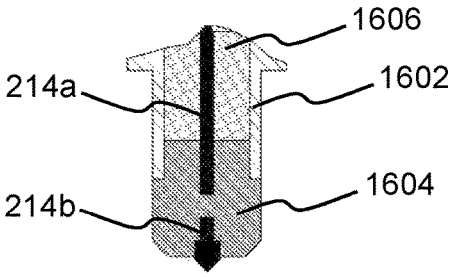
FIG. 19A is a cross-sectional view of the tip portion of a second igniter, according to an embodiment of the invention.
Figure 18B:
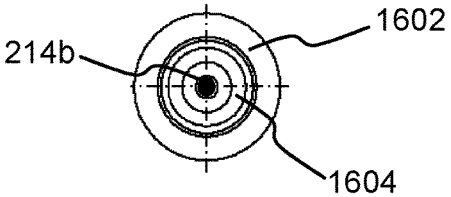
FIG. 18B is an end-view of the tip of FIG. 18A.
Figure 19B:
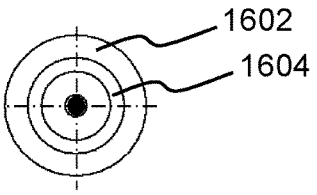
FIG. 19B is an end-view of the tip of FIG. 19A.

FIGS. 18A-22B depict various different igniter tip geometries. It is to be understood that while the different tip geometries are described herein with specific reference to the igniter 206 of FIG. 2, they may also be used equally well with the igniter 306 of FIG. 3. Part (A) of each figure shows a cross-sectional view taken through an igniter tip, and part (B) of the same figure shows a corresponding end view of the same igniter tip. Now with specific reference to FIGS. 18 and 19, the high voltage electrode 214 is divided into the first electrode 214*a* and the second electrode 214*b* by the insulator material 1604, such that the gap between the first and second electrodes forms a capacitor. Although direct current cannot be conducted through the insulator material 1604 between the first and second electrodes, high voltage AC can be transmitted between the electrodes 214*a* and 214*b* due to the dielectric character of the insulator element 1604. During discharge, in addition to the impedance of the gas in the combustion zone, extra impedance results between the electrodes. During a corona discharge, the insulator dissipates some energy due to the added impedance. However, when an arc occurs in the combustion zone 208, the impedance of the gas in the combustion zone suddenly drops to nearly zero, leading to a sharp increase of energy dissipation on the insulator. When more energy is dissipated on the insulator, then the energy supplied to the arc channel is reduced. As a result, the arcing duration is shortened or the arcing is eliminated entirely. As is apparent, the tip geometries shown in FIGS. 18A and 19A are similar. In both cases one centered discharge tip is provided, but as shown in FIG. 18A there is a step at the joint between the metal shell 1602 and the insulator material 1604, and as shown in FIG. 19A the outer surfaces of the metal shell 1602 and of the insulator element 1604 are flush with one another at the joint.

Figure 20A:
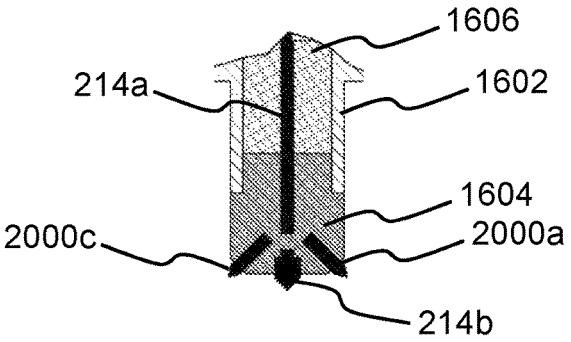
FIG. 20A is a cross-sectional view of the tip portion of a third igniter, according to an embodiment of the invention.

FIG. 20 shows an igniter tip geometry with multiple discharge tips 2000*a-d*. The tips 2000*a-d* are shown in a symmetrical arrangement around the center tip 214*b*, to provide five different discharge locations. Of course, a number of tips other than five is also envisaged.

Figure 21A:
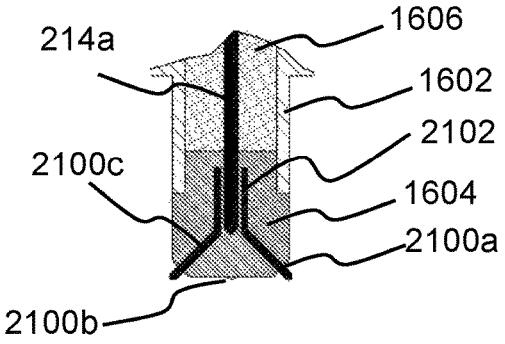
FIG. 21A is a cross-sectional view of the tip portion of a fourth igniter, according to an embodiment of the invention.
Figure 20B:
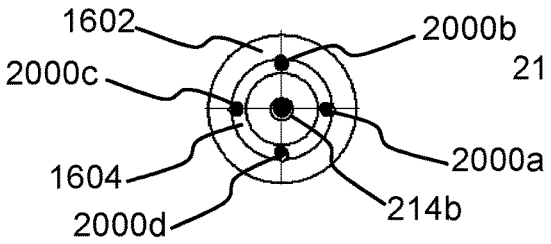
FIG. 20B is an end-view of the tip of FIG. 20A.
Figure 21B:
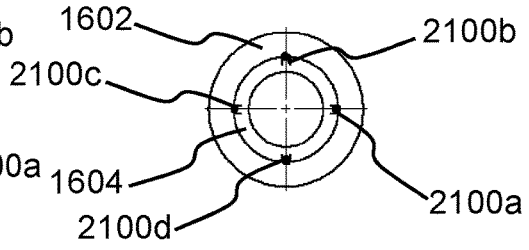
FIG. 21B is an end-view of the tip of FIG. 21A.

FIG. 21 shows an igniter tip geometry with multiple discharge tips 2100*a-d* that project from a cylindrical component 2102 encircling the electrode 214*a*. The discharge tips 2100*a-d* form a symmetrical (square) pattern at the combustion-side face of the igniter tip as shown in FIG. 21*a*, but the central electrode 214*b* that is shown in FIGS. 18A-20B is absent. Of course, a number of discharge tips other than four is also envisaged.

Figure 22A:
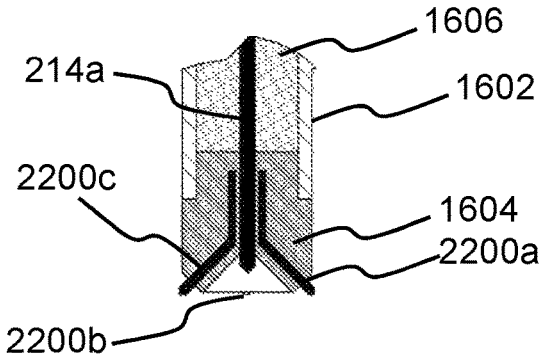
FIG. 22A is a cross-sectional view of the tip portion of a fifth igniter, according to an embodiment of the invention.
Figure 22B:
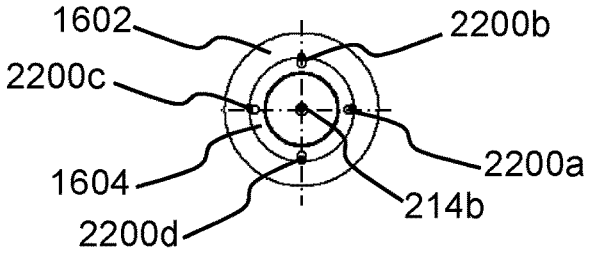
FIG. 22B is an end-view of the tip of FIG. 22A.
Figure 23:
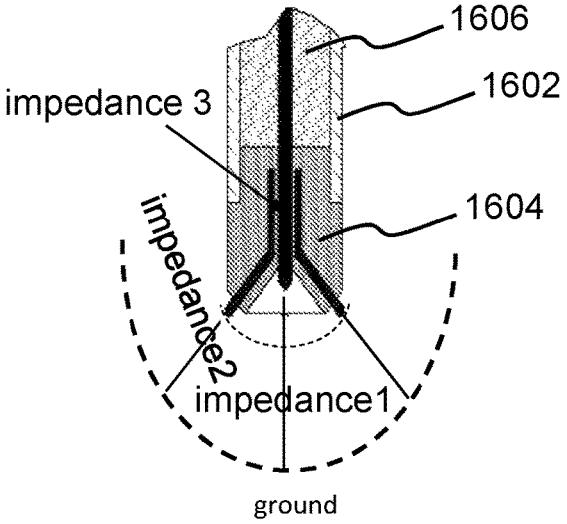
FIG. 23 depicts different impedances along different pathways at the tip of the igniter depicted in FIGS. 22A and 22B.

FIG. 22 shows an igniter tip geometry with the central electrode 214*a* exposed to the combustion zone, and with multiple discharge tips 2200*a-d*. The discharge tips 2200*a-d* are geometrically closer to the ground relative to the central electrode 214*a*. Now referring also to FIG. 23, the impedance between the central electrode 214*a* and ground is higher than the impedance between the electrode tips 2200*a-d* and ground. As such, when the combustion zone operates under conditions of low pressure (low density), the impedance between the central electrode 214*a* and the discharge tips 2200*a-d* through the combustion-zone gas is lower than that through the insulator material 1604, and discharge occurs on the central electrode tip 214*a*. When the combustion zone operates under conditions of relatively high pressure (i.e. high density), the impedance between the central electrode 214*a* and the discharge tips 2200*a-d* through the gas is higher than that through the insulator material 1604, and discharge occurs on the discharge tips 2200*a-d*.

While the above description constitutes a plurality of embodiments of the invention, it will be appreciated that the present invention is susceptible to further modification and change without departing from the fair meaning of the accompanying claims.

What is claimed is:

1. An ignition device for producing a corona discharge for igniting an air/fuel mixture in an internal combustion engine, comprising:

a metallic tube housing;

an insulator element fabricated from an insulator material and fixedly secured at a combustion end of the metallic tube housing;

a coil wound onto a holder and disposed within the metallic tube housing;

a filler material disposed between the coil and the metallic tube housing; and a high voltage electrode arrangement comprising:

a first electrode having a first end that is connected to the coil for receiving a voltage therefrom, the first electrode extending at least part of the way through the insulator element; and at least one second electrode having a first end that protrudes from a combustion-side face of the insulator element and having a second end that is embedded within the insulator element, the second end of the at least one second electrode being separated from the first electrode by the insulator material and for capacitively coupling with the first electrode to receive a drive signal therefrom, the at least one second electrode for supporting a corona discharge therefrom, wherein the at least one second electrode consists of one second electrode, wherein the first electrode has a second end that is embedded within the insulator element, wherein the second electrode and the first electrode are axially aligned one with the other such that the second end of the first electrode faces toward the second end of the second electrode, and wherein a space between the second end of the first electrode and the second end of the second electrode is filled with the insulator material of the insulator element.

2. The ignition device according to claim 1, wherein the dielectric constant of the filler material is less than the dielectric constant of aluminum oxide.

3. The ignition device according to claim 1, wherein the dielectric constant of the filler material is less than 3.

4. An ignition device for producing a corona discharge for igniting an air/fuel mixture in an internal combustion engine, comprising:

a metallic tube housing;

an insulator element fabricated from an insulator material and fixedly secured at a combustion end of the metallic tube housing;

a coil wound onto a holder and disposed within the metallic tube housing;

a filler material disposed between the coil and the metallic tube housing; and a high voltage electrode arrangement comprising:

a first electrode having a first end that is connected to the coil for receiving a voltage therefrom, the first electrode extending at least part of the way through the insulator element; and at least one second electrode having a first end that protrudes from a combustion-side face of the insulator element and having a second end that is embedded within the insulator element, the second end of the at least one second electrode being separated from the first electrode by the insulator material and for capacitively coupling with the first electrode to receive a drive signal therefrom, the at least one second electrode for supporting a corona discharge therefrom, wherein the at least one second electrode consists of one second electrode, wherein the first electrode has a second end that is embedded within the insulator element, and wherein the second end of the one second electrode comprises a cylinder that overlaps with a portion of the length of the first electrode adjacent to the second end of the first electrode.

5. The ignition device according to claim 4, wherein the one second electrode comprises a plurality of electrode tips extending away from the cylinder and forming a pattern of electrode tips protruding from the combustion-side face of the insulator element.

6. The ignition device according to claim 4, wherein the dielectric constant of the filler material is less than the dielectric constant of aluminum oxide.

7. The ignition device according to claim 4, wherein the dielectric constant of the filler material is less than 3.

8. An ignition device for producing a corona discharge for igniting an air/fuel mixture in an internal combustion engine, comprising:

a metallic tube housing;

an insulator element fabricated from an insulator material and fixedly secured at a combustion end of the metallic tube housing;

a coil wound onto a holder and disposed within the metallic tube housing;

a filler material disposed between the coil and the metallic tube housing; and a high voltage electrode arrangement comprising:

a first electrode having a first end that is connected to the coil for receiving a voltage therefrom, the first electrode extending at least part of the way through the insulator element; and at least one second electrode having a first end that protrudes from a combustion-side face of the insulator element and having a second end that is embedded within the insulator element, the second end of the at least one second electrode being separated from the first electrode by the insulator material and for capacitively coupling with the first electrode to receive a drive signal therefrom, the at least one second electrode for supporting a corona discharge therefrom, wherein the at least one second electrode comprises a plurality of second electrodes each having a respective second end that is embedded within the insulator element and that is separated from the first electrode by the insulator material.

9. The ignition device according to claim 8, wherein one second electrode of the plurality of second electrodes is axially aligned with the first electrode, wherein the rest of the second electrodes of the plurality of second electrodes extend away from the first electrode at respective non-zero angles relative to the longitudinal axis of the first electrode and form a pattern of electrodes protruding from the combustion-side face of the insulator element, and wherein the one second electrode protrudes from the combustion-side face of the insulator element at a location at a center of said pattern.

10. The ignition device according to claim 8, wherein the first electrode has a second end that is embedded within the insulator element, and wherein the second end of one second electrode of the plurality of second electrodes comprises a cylinder that overlaps with a portion of the length of the first electrode adjacent to the second end of the first electrode.

11. The ignition device according to claim 10, comprising a plurality of electrode tips extending away from the cylinder and forming a pattern of electrode tips protruding from the combustion-side face of the insulator element.

12. The ignition device according to claim 11, comprising a further second electrode having a first end that protrudes from the combustion-side face of the insulator element at a location at a center of the pattern of electrode tips, and having a second end that is embedded within the insulator element, the further second electrode and the first electrode being axially aligned one with the other such that the second end of the first electrode faces toward the second end of the further second electrode.

13. The ignition device according to claim 8, wherein the dielectric constant of the filler material is less than the dielectric constant of aluminum oxide.

14. The ignition device according to claim 8, wherein the dielectric constant of the filler material is less than 3.

15. An ignition device for producing a corona discharge for igniting an air/fuel mixture in an internal combustion engine, comprising:

a metallic tube housing;

an insulator element fabricated from an insulator material and fixedly secured at a combustion end of the metallic tube housing;

a coil wound onto a holder and disposed within the metallic tube housing;

a filler material disposed between the coil and the metallic tube housing; and a high voltage electrode arrangement comprising:

a first electrode having a first end that is connected to the coil for receiving a voltage therefrom, the first electrode extending at least part of the way through the insulator element; and at least one second electrode having a first end that protrudes from a combustion-side face of the insulator element and having a second end that is embedded within the insulator element, the second end of the at least one second electrode being separated from the first electrode by the insulator material and for capacitively coupling with the first electrode to receive a drive signal therefrom, the at least one second electrode for supporting a corona discharge therefrom, wherein the first electrode extends through the insulator element and has a second end that protrudes from the combustion-side face of the insulator element, and wherein the second end of the at least one second electrode comprises a cylinder that overlaps with a portion of the length of the first electrode.

16. The ignition device according to claim 15, comprising a plurality of electrode tips extending away from the cylinder and forming a pattern of electrode tips protruding from the combustion-side face of the insulator element, wherein the second end of the first electrode protrudes from the combustion-side face of the insulator element at a location at a center of the pattern of electrode tips.

17. The ignition device according to claim 15, wherein the dielectric constant of the filler material is less than the dielectric constant of aluminum oxide.

18. The ignition device according to claim 15, wherein the dielectric constant of the filler material is less than 3.

* * * * *